United States Patent [19]

Kato

[11] Patent Number: 4,848,636

[45] Date of Patent: Jul. 18, 1989

[54] ROLL FEED APPARATUS

[75] Inventor: Heizaburo Kato, Shizuoka, Japan

[73] Assignee: Sankyo Manufacturing Company, Ltd., Tokyo, Japan

[21] Appl. No.: 230,086

[22] Filed: Aug. 9, 1988

Related U.S. Application Data

[63] Continuation of Ser. No. 130,848, Dec. 9, 1987, Pat. No. 4,776,505.

[30] Foreign Application Priority Data

Apr. 20, 1987 [JP] Japan ..... 62-59639

[51] Int. Cl.[4] ..... B65H 20/18; B65H 20/02; B65H 20/04

[52] U.S. Cl. ..... 226/152; 226/149; 226/154; 226/158; 226/161

[58] Field of Search ..... 226/139, 141, 142, 147, 226/149, 152, 156

[56] References Cited

U.S. PATENT DOCUMENTS

| | | | |
|---|---|---|---|
| 4,304,348 | 12/1981 | Kato | 226/152 |
| 4,415,108 | 11/1983 | Katoh | 226/154 X |
| 4,475,678 | 10/1984 | Katoh | 226/143 |
| 4,487,352 | 12/1984 | Paris | 226/142 |
| 4,601,420 | 7/1986 | Kato | 226/149 X |

FOREIGN PATENT DOCUMENTS

| | | |
|---|---|---|
| 55-119642 | 9/1980 | Japan . |
| 57-75230 | 5/1982 | Japan . |
| 59-130831 | 9/1984 | Japan . |
| 59-130832 | 9/1984 | Japan . |
| 61-32150 | 2/1986 | Japan . |

*Primary Examiner*—Stuart S. Levy
*Assistant Examiner*—Phillip S. Han
*Attorney, Agent, or Firm*—Pollock, Vande Sande & Priddy

[57] ABSTRACT

A roll feed apparatus for intermittently feeding a strip by a constant length into manufacturing machines. A pair of first and second rolls and a pair of first and second brake shoes are arranged along a strip transporting path. The rolls move swingingly in a strip transporting direction to transport the strip clamped between the rolls. The rolls move away from each other when they swingingly move in a direction opposite to the strip transporting direction. First and second cams are mounted respectively on outer and inner shaft members of a drive shaft for rotation therewith. The inner shaft member can be adjusted in its angular position relative to the outer shaft member. The cams are operatively connected to the second brake shoe. The cams can be positioned at such a relative position therebetween that the cams cause the brake shoes to clamp the strip therebetween to fix the strip during a period for which the rolls do not transport the strip, and at a point of time during the period, one of the cams causes the brake shoes to release the strip temporarily.

4 Claims, 9 Drawing Sheets

ROLL FEED APPARATUS

This is a continuation of Ser. No. 130,848, filed on Dec. 9, 1987 now U.S. Pat. No. 4,776,505.

BACKGROUND OF THE INVENTION

1. Field of the Invention

The present invention relates to a roll feed apparatus of type in which a pair of rolls clamps a strip therebetween to intermittently feed the strip by a constant length into manufacturing machines such as a press machine or the like.

2. Description of the Prior Art

A roll feed apparatus of the type referred to above is known, which comprises a drive shaft driven rotatively, a pair of first and second roll shafts and a pair of first and second rolls mounted respectively on the first and second roll shafts for swinging movement therewith. A swingingly driving device is provided for converting the rotative motion of the drive shaft to swinging motion of the first and second rolls. The first and second rolls cooperate with each other to clamp therebetween a strip to transport the same when the first and second rolls are moved swingingly by the swingingly driving device in a strip transporting direction. A roll release device is provided for moving the first and second rolls aways from each other when the rolls move swingingly in a direction opposite to the strip transporting direction, to release a clamping force applied to the strip by the first and second rolls. A strip braking device is provided for applying brake to the strip to fix the same for a period during which the rolls do not transport the strip. Such type of roll feed apparatus is disclosed, for example, in Japanese Utility Model Application Laid-Open No. 59-130831 (Utility Model Application No. 58-24892), Japanese Utility Model Application Laid-Open No. 59-130832 (Utility Model Application No. 58-24893), Japanese Utility Model Application Laid-Open No. 61-32510 (Utility Model Application No. 59-114306) and the like.

If the roll feed apparatus of the type described above is employed in combination with, for example, a press machine, the first and second rolls become stationary after having fed the strip by a constant strength into a die assembly of the press machine. After having become stationary, that is, for the period during which the rolls do not transport the strip, the rolls are moved away from each other by the roll release device, and the strip is fixed by the strip braking device. Under such condition, the rolls are moved swingingly in the direction opposite to the strip transporting direction. During this period of swinging motion of the rolls, press working is effected on the strip fed into the die assembly while the strip is fixed by the strip braking device.

The above-described conventional roll feed apparatus has such a problem that it might not accurately position a strip in manufacturing machines such as a press machine or the like. Specifically, some types of the press machines comprise a die assembly in which pilot pins project downwardly from a lower surface of an upper die, and are adapted to be inserted respectively into receiving holes formed beforehand in the strip when the upper die and a lower die are brought into engagement with each other to perform press working, whereby the strip can accurately be positioned in the die assembly. In the above-described conventional roll feed apparatus, however, since the strip is maintained fixed by the strip braking device when the upper and lower dies are brought into engagement with each other to perform press working, it is impossible for the pilot pins to position the strip if slight positional displacement or shift exists between the pilot pins and the receiving holes in the strip fed into the die assembly. Thus, there are anxieties that the positioning is not performed accurately, causing a deformation of the strip and a damage or breakage of the dies.

SUMMARY OF THE INVENTION

It is an object of the invention to provide a roll feed apparatus which can resolve the above-discussed problem of the prior art.

In the roll feed apparatus of the type described above, the invention is characterized in that the drive shaft includes an outer hollow shaft member and an inner shaft member fixedly arranged within the outer shaft member such that the inner shaft member is adjustable in its angular position relative to the outer shaft member, and that the strip braking device includes a pair of first and second brake shoes confronting each other with a strip transporting path passing between the brake shoes, a first cam mounted on the outer shaft member for rotation therewith, a second cam mounted on the inner shaft member for rotation therewith, and interlocking means having a cam follower in engagement with the first and second cams, for operatively connecting the first and second cams to the second brake shoe to move the same toward and away from the first brake shoe in response to rotation of the first and second cams, thereby causing the first and second brake shoes to fix and release the strip, the first and second cams being able to be positioned at such a relative position therebetwen that during a period for which the first and second rolls do not transport the strip, the first and second cams cause the first and second brake shoes to fix the strip, and at a predetermined point of time during the period, one of the first and second cams causes the first and second brake shoes to release the strip temporarily.

In the roll feed apparatus according to the invention, fixing of the strip is effected by the first and second brake shoes during the period for which the first and second rolls do not transport the strip. However, the strip is released from the first and second brake shoes and becomes free temporarily during the period, by the action of one of the first and second cams. The timing, at which the strip becomes free, can easily be adjusted by adjustment of the angular position of the inner shaft member relative to the outer shaft member to adjust the relative position between the first and second cams. Thus, if the roll feed apparatus is employed, for example, in combination with the above-described press machine, the relative position between the first and second cams is so set that the strip becomes free when the upper and lower dies are brought into engagement with each other. By doing so, even if the pilot pins shift in position from the receiving holes formed in the strip, the pilot pins are inserted respectively into the receiving holes while slightly displacing the strip. This makes it possible to accurately position the strip.

DETAILED DESCRIPTION OF THE PREFERRED EMBODIMENT

Figure 1:
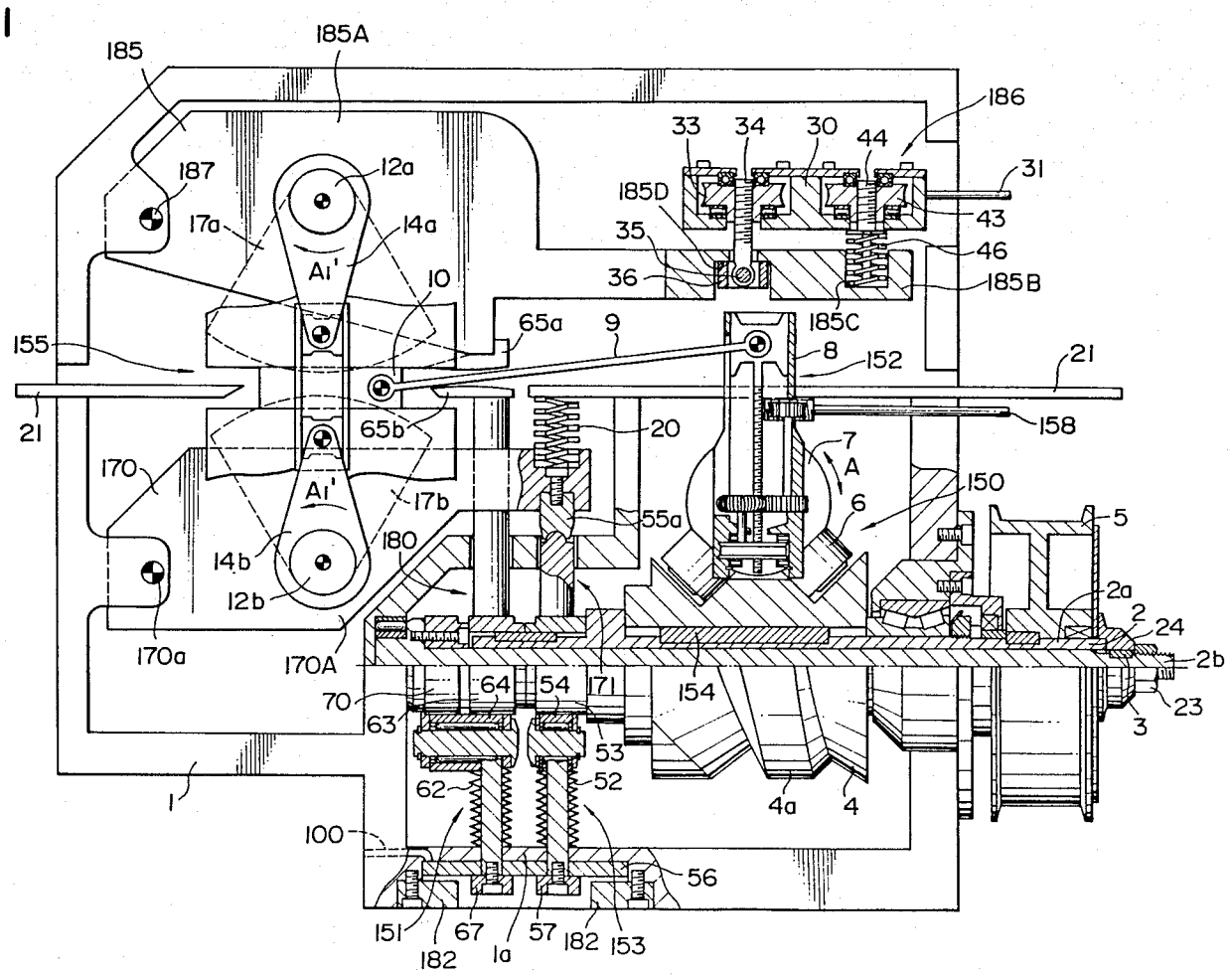
FIG. 1 is a partially cross-sectional view showing an entire arrangement of a roll feed apparatus according to an embodiment of the invention.

The invention will be described in detail with reference to an embodiment illustrated in the drawings.

GENERAL ARRANGEMENT

As shown in FIG. 1, a roll feed apparatus according to the illustrated embodiment comprises a drive shaft 2 which is rotatively driven through a pulley 5. A swingingly driving device 150 is provided which converts the rotative motion of the drive shaft 2 to swinging motion of a pair of upper and lower or first and second rolls 17*a* and 17*b*. The first roll 17*a* is mounted on a first roll shaft 12*a* for swinging movement therewith. The second roll 17*b* is mounted on a second roll shaft 12*b* for swinging movement therewith, which extends parallel to the first roll shaft 12*a*. The first and second rolls 17*a* and 17*b* cooperate with each other to clamp therebetween a strip to transport the same. The first and second rolls 17*a* and 17*b* are interlocked with each other by an interlocking mechanism 155. A rotation transmitting device 152 is provided which transmits the swinging motion of the swingingly driving device 150 to the interlocking mechanism 155. The roll feed apparatus further comprises a roll release device 153 and a strip braking device 151. Each of the first and second rolls 17*a* and 17*b* has a sectoral shape in cross-section in a plane perpendicular to a swinging axis of the roll, that is, is formed by a sector roll.

DRIVE SHAFT

The drive shaft 2 is composed of an outer hollow shaft member 2*a* and an inner shaft member 2*b* fitted in the outer shaft member 2*a*. A flange member 24 is mounted on the inner shaft member 2*b* through a key 3 and engages an outer periphery of the outer shaft member 2*a*. The flange member 24 is tightened by a nut 23 to fix the outer and inner shaft members 2*a* and 2*b* to each other for rotation together. With the nut 23 loosened, rotation of the flange member 24 permits the inner shaft member 2*b* to angularly move relative to the outer shaft member 2*a*. Accordingly, tightening of the nut 23 after having angularly moved the inner shaft member 2*b* to an appropriate angular position makes it possible to adjust the relative angular position between the outer and inner shaft members 2*a* and 2*b*.

SWINGINGLY DRIVING DEVICE

The swingingly driving device 150 comprises a solid cam 4 mounted on the outer shaft member 2*a* of the drive shaft 2 through a key 154 for rotation with the outer shaft member 2*a*, and a turret 7 having cam followers 6 in engagement with respective cam surfaces of the solid cam 4. When the solid cam 4 rotates together with the drive shaft 2, the turret 7 swings as indicated by the arrow A in compliance with the profile of the cam surfaces. The swingingly driving device of the type comprising the solid cam and the turret as described above is well known, as is disclosed in, for example, Japanese Patent Application Laid-Open Nos. 55-119642 and 57-75230. In the illustrated embodiment, a roller gear cam having a tapered rib 4*a* is employed as the solid cam 4. Two cam followers 6 engage the cam surfaces of the solid cam, respectively.

ROTATION TRANSMITTING DEVICE AND INTERLOCKING MECHANISM

Figure 2:
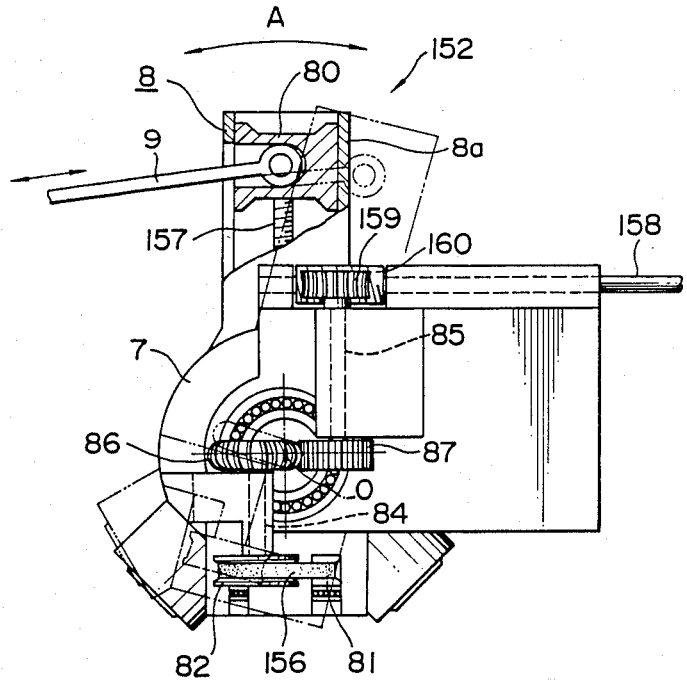
FIG. 2 is a partially broken-away fragmental view of a swinging structure incorporated in the roll feed apparatus illustrated in FIG. 1.

As shown in FIGS. 1 and 2, the rotation transmitting device 152 comprises a swinging structure 8 mounted on a central shaft of the turret 7 for swinging movement A together with the turret 7 about a point O. A connecting rod 9 connects a slidable block 80 within the swinging structure 8 to a slider 10 of the interlocking mechanism 155 illustrated in FIGS. 1, 3, 4 and 5.

Figure 3:
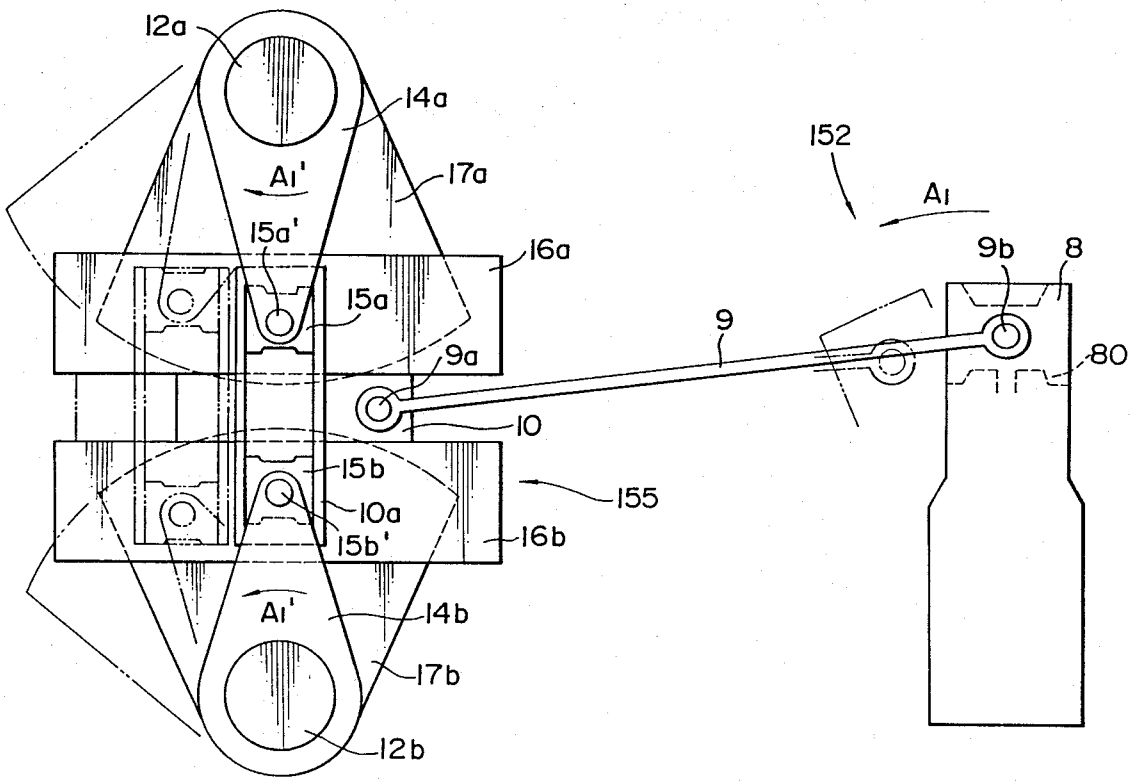
FIG. 3 is a fragmental front elevational view of an interlocking mechanism for first and second rolls.
Figure 4:
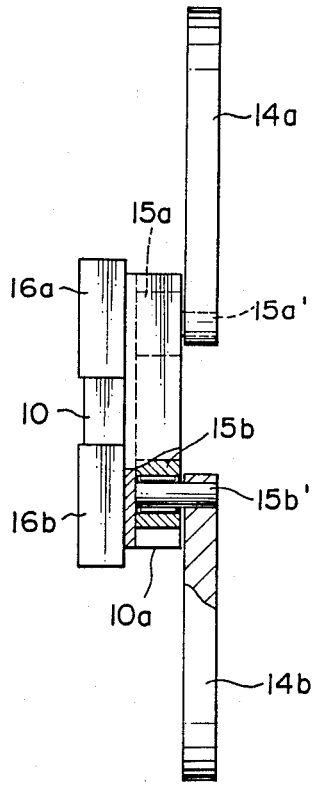
FIG. 4 is a fragmental side elevational view of FIG. 3.
Figure 5:
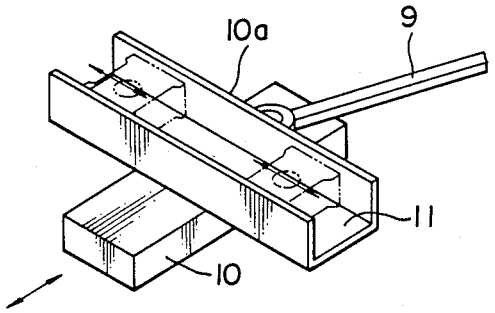
FIG. 5 is a perspective view of a slider of the interlocking mechanism illustrated in FIG. 3.

As clearly shown particularly in FIGS. 3, 4 and 5, the interlocking mechanism 155 comprises a first swinging arm 14*a* having one end thereof mounted on one end $12a_1$ (see FIG. 6) of the first roll shaft 12 for swinging movement therewith, a second swinging arm 14*b* having one end thereof mounted on one end $12b_1$ (see FIG. 6) of the second roll shaft 12*b* for swinging movement therewith, and the slider or slide block 10 slidable in the right- and left-hand direction as viewed in FIG. 3 along guide blocks 16*a* and 16*b* which are fixedly mounted within a housing 1 (see FIG. 1) of the roll feed apparatus. As shown in FIG. 5, a channel member 10*a* having formed therein a guide groove 11 is fixedly mounted on an upper surface of the slide block 10. Slide blocks 15*a* and 15*b* mounted slidably in the guide groove 11 are pivotally connected respectively to the other ends of the respective first and second swinging arms 14*a* and 14*b* through respective pins 15*a*′ and 15*b*′. Thus, as the swinging structure 8 swings, for example, in the direction $A_1$ in FIG. 3, the connecting rod 9 causes the slide block 10 to slide to the left. This causes the first and second swinging arms 14*a* and 14*b* to swing in their respective directions opposite to each other as indicated by the arrows $A_1'$ and $A_1'$ while the slide blocks 15*a* and 15*b* slide longitudinally in the guide groove 11. Thus, the first and second roll shafts 12*a* and 12*b*, on which the swinging arms 14*a* and 14*b* are fixedly mounted, move angularly to thereby swing the first and second rolls 17*a* and 17*b* as indicated by the arrows $A_1'$ and $A_1'$. As shown in FIG. 3, the connecting rod 9 has one end thereof pivotally connected to the slide block 10 through a pin 9*a*, and the other end pivotally connected to the slide block 80 of the swinging structure 8 through a pin 9*b*.

The swinging structure 8 is so arranged that sliding movement of the slide block 80 longitudinally of the swinging structure 8 varies the amount of sliding movement of the slide block 10 in the left- and right-hand direction as viewed in FIG. 3 with respect to swinging angles of the swinging structure 8, thereby making it possible to vary the swinging angles of the respective rolls 17*a* and 17*b* with respect to the swinging angles of the swinging structure 8. The swinging structure per se is similar to that disclosed in, for example, the above-mentioned Japanese Utility Model Application Laid-Open Nos. 59-130831, 59-130832 and 61-32150, and the detailed description of the swinging structure will therefore be omitted. However, the swinging structure will be outlined below.

As shown in FIGS. 1 and 2, the swinging structure 8 comprises an arm 8*a* mounted on the central shaft of the turret 7 for swinging movement therewith, the slide block 80 received in the arm 8*a*, an arcuate surface gear 86 mounted on the arm 8*a*, and a spur gear 87 rotatably mounted to the housing 1 of the roll feed apparatus and in mesh with the arcuate surface gear 86. The arcuate surface gear 86 can move swingingly together with the arm 8*a* when the latter swings together with the turret 7 about the point O as indicated by the arrow A. The arcuate surface gear 86 is mounted on a rotary shaft 84 for rotation therewith. That is, when the arm 8*a* swings about the point O, the arcuate surface gear 86 swings together with the arm 8*a*. During the swinging motion, the arcuate teeth of the arcuate surface gear 86 move in the arcuate direction, i.e., in the swinging direction with respect to the teeth of the stationary spur gear 87. When the spur gear 87 rotates together with its rotary shaft 85, the arcuate surface gear 86 rotates together with the rotary shaft 84.

Mounted to a lower end of the arm 8*a* are a pair of pulleys 81 and 82 which are interlocked with each other by a belt 156. The pulley 82 is mounted on a lower end of the rotary shaft 84 of the arcuate surface gear 86 for rotation with the rotary shaft 84. A screw rod 157 has a lower end which is threadedly engaged with the pulley 81. An upper end of the screw rod 157 is fixedly connected to the slide block 80. Rotation of a rod 158 causes the rotary shaft 85 and the spur gear 87 mounted thereon to be rotated through a worm gear 159 and a worm wheel 160. Then, the pulley 81 is rotated through the arcuate surface gear 86, the rotary shaft 84, the pulley 82 and the belt 156. Rotation of the pulley 81 causes the screw rod 157 and the slide block 80 to be moved in the arm 8*a* longitudinally thereof. Such movement of the slide block 80 varies the swinging angles of the respective rolls 17*a* and 17*b* with respect to the swinging angles of the swinging structure 8 as described previously. In this manner, the swinging angles of the respective rolls are varied by movement of the slide block 80, to thereby make it possible to vary a single amount of transportation of the strip intermittently transported by the roll feed apparatus.

FIRST AND SECOND ROLLS

Figure 6:
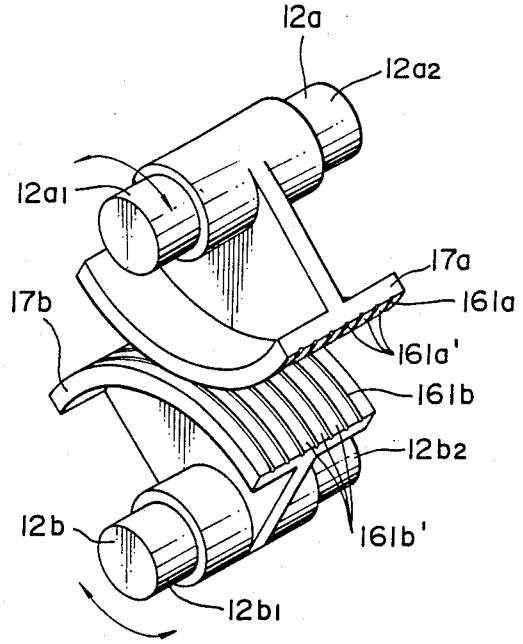
FIG. 6 is a perspective view showing the first and second rolls.

As clearly shown particularly in FIG. 6, the first and second rolls 17*a* and 17*b* are in the form of a sector, and a plurality of grooves 161*a* and 161*b* are formed respectively in peripheral surfaces of the respective rolls 17*a* and 17*b*. The grooves 161*a* and 161*b* are provided for preventing slippage of the strip and for enabling the strip to be fed without scratching the strip. Specifically, in some types of the conventional roll feed apparatuses which are utilized to feed a strip into a press machine for press-working small size parts, each of a pair of rolls has a smooth peripheral surface. In case of such rolls, however, slippage would occur if oil, solvent or the like is deposited on the strip, resulting in such a drawback that the strip feeding accuracy deteriorates. In order to dissolve such drawback, an arrangement has been proposed in which fine irregularities like a pear's skin are formed on a peripheral surface of each of a pair or rolls. However, such arrangement has a drawback that the strip is scratched. In the grooves 161*a* and 161*b* are provided as is in the illustrated embodiment, the oil flows well through the grooves so that slippage of the strip can be prevented. In addition, since the strip is clamped between smooth land surfaces 161*a'* and 161*b'*, it is also possible to prevent the strip from being scratched.

ROLL RELEASE DEVICE

As will be clear from the foregoing description, the first and second rolls 17*a* and 17*b* are connected to each other by the interlocking mechanism 155 in such a manner that when the first roll swings by a predetermined angular extent in one direction, the second roll swings by substantially the same angular extent in the opposite direction. Accordingly, if the strip is clamped between the first and second rolls 17*a* and 17*b* when the first roll 17*a* swings, for example, in the clockwise direction $A_1$40 in FIG. 3 and the second roll 17*b* swings in the counterclockwise direction $A_1'$ (hereinafter, swinging movement of the rolls in such respective directions will be referred to as swinging movement in a strip transporting direction), the strip is transported to the left by an amount or length corresponding to the swinging angles of the rolls. Thus, since the first and second rolls move swingingly, it is required to move the first and second rolls away from each other to release the clamping force applied to the strip by the rolls so as to prevent the strip from being transported to the right, when the rolls swing in the direction opposite to the strip transporting direction, that is, when the first roll 17*a* swings in the counterclockwise direction and the second roll 17*b* swings in the clockwise direction (hereinafter, swinging movement of the rolls in such resepctive directions will be referred to as swinging movement in a direction opposite to the strip transporting direction). A device for moving the rolls away from each other when they swing in the direction opposite to the strip transporting direction is the roll release device 153. Specific arrangement of the roll release device 153 will be described below with reference to FIGS. 1 and 7.

The roll release device 153 in the illustrated embodiment comprises a third cam 53 mounted on the outer shaft member 2*a* of the drive shaft 2 for rotation therewith, and a first interlocking mechanism 171 which has a roll release cam follower 54 in engagement with the third cam 53 and a pivoting structure 170. The pivoting structure 170 includes a pivoting plate 170A having one end thereof pivotally mounted on a pivot 170*a*. The pivoting plate 170A is mounted, at its longitudinally midway position, on the one end 12*b*$_1$ (see FIG. 6) of the second roll shaft 12*b* for angular movemetn relative to the one end 12*b*$_1$. The pivoting plate 170A is located on the front of the drawing sheet with respect to the second roll 17*b* as viewed in FIG. 1, and on the rear of the drawing sheet with respect to the second swinging arm 14*b*. The pivoting structure 170 further includes a second pivoting plate (not shown) identical in configuration with the pivoting plate 170A. The second pivoting plate has one end thereof pivotally mounted on the other of the pivot 170*a*. The second pivoting plate is mounted, at its longitudinally midway position, on the other end $12b_2$ (see FIG. 6) of the second roll shaft 12b for angular movement relative to the other end $12b_2$. The second pivoting plate is located on the rear of the drawing sheet with respect to the second roll 17b as viewed in FIG. 1. A rod-like member extending perpendicularly to the drawing sheet of FIG. 1 connects a free end of the pivoting plate 170A to a free end of the second pivoting plate.

The above-mentioned interlocking mechanism 171 comprises a pair of actuating shafts 51a and 51b, and a holder 50 which is mounted on the actuating shafts 51a and 51b for sliding movement therealong and which holds the cam follower 54. The actuating shafts 51a and 51b have their respective small diameter portions $51a_1$ and $51b_1$ each of which has a lower section fitted in a corresponding bore formed in the housing 1 and a lower end fixed to a support plate 57. Large diameter portions $51a_2$ and $51b_2$ are integrally connected respectively to upper ends of the respective small diameter portions $51a_1$ and $51b_1$, with steps 51a' and 51b' formed respectively therebetween. Semi-spherical couplings $51a_2'$ and $51b_2'$ are provided respectively at upper end faces of the respective large diameter portions $51a_2$ and $51b_2$. Upper shaft members $51a_3$ and $51b_3$ have their respective lower ends which are pivotally fitted respectively on the couplings $51a_2'$ and $51b_2'$. Upper ends of the respective upper shaft members $51a_3$ and $51b_3$ are fixedly connected to the free end of the pivoting structure 170. The actuating shafts 51a and 51b are usually biased downwardly through the free end of the pivoting structure 170 by third springs 20 interposed between the free end of the pivoting structure 170 and a guide plate 21 (see FIG. 1). The guide plate 21 is fixedly mounted to the housing 1 of the roll feed apparatus for guiding the strip when the latter is transported.

The above-mentioned holder 50 is mounted on the small diameter portions $51a_1$ and $51b_1$ of the respective actuating shafts 51a and 51b and is usually biased upwardly by a pair of fourth springs 52. Biasing force of the fourth springs 52 causes the cam follower 54 to be urged against the third cam 53, and causes the holder 50 to urged against the steps 51a' and 51b'.

The roll release device 153 in the illustrated embodiment is constructed as described above. When the cam 53 is in a position shown in FIG. 7, the fourth springs 52 pushes the holder 50 upwardly, to push the entire shafts 51a and 51b upwardly through the steps 51a' and 51b', so that the free end of the pivoting assembly 170 is pushed upwardly against the biasing force of the third springs 20. Thus, the pivoting structure 170 pivotally moves about the pivot 170a in the counterclockwise direction as viewed in FIG. 1, to move upwardly the second roll shaft 12b together with the second roll 17b. As a consequence, the rolls 17a and 17b move toward each other and can clamp the strip therebetween. As the drive shaft 2 rotates to rotate the third cam 53 from the position shown in FIG. 7 to a position where the neighborhood of a projection 53a on the third cam 53 is brought into engagement with the cam follower 54, the third cam 53 pushes the cam follower 54 down so that the holder 50 is pushed down against the biasing force of the fourth springs 52. Simultaneously, the third springs 20 push down the free end of the pivoting structure 170 and the actuating shafts 51a and 51b. This causes the pivoting structure 170 to pivotally move about the pivot 170a in the clockwise direction as viewed in FIG. 1, to move the second roll 17b downwardly away from the first roll 17a. Thus, the clamping force applied to the strip by the rolls 17a and 17b is released. It is apparent that when the actuating shafts 51a and 51b move up and down as described above, the support plate 57 also moves up and down together with the actuating shafts. Springs 181a and 181b associated with the support plate 57 usually bias the actuating shafts 51a and 51b downwardly through the support plate 57. Thus, the springs 181a and 181b compensate for the spring action of the third springs 20 during operation of the roll release device 153.

STRIP BRAKING DEVICE

Figure 8:
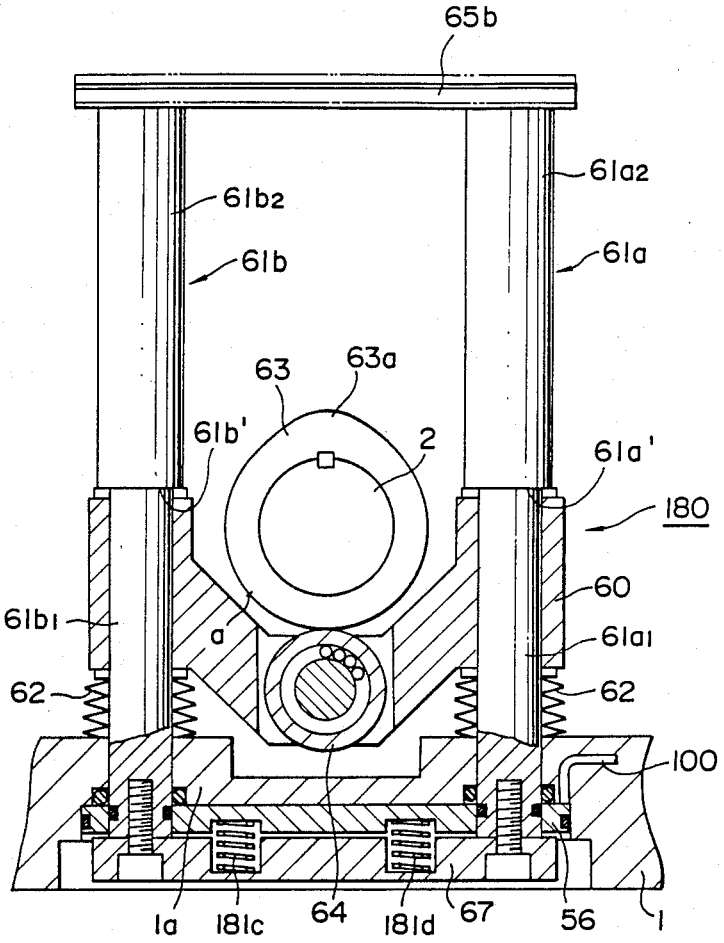
FIG. 8 is a cross-sectional view showing an interlocking mechanism of a strip braking device, as viewed in side elevation of FIG. 1.

As shown in FIGS. 1 and 8, the above-mentioned strip braking device 151 comprises a pair of first and second brake shoes 65a and 65b confronting each other with the strip transporting path passing therebetween, a first cam 63 mounted on the outer shaft member 2a of the drive shaft 2 for rotation therewith, a second cam 70 mounted on the inner shaft member 2b of the drive shaft 2 for rotation therewith, and a second interlocking mechanism 180 operatively connecting the first and second cams 63 and 70 to the second brake shoe 65b.

The second interlocking mechanism 189 comprises a pair of actuating shafts 61a and 61b, and a holder 60 which is mounted on the actuating shafts 61a and 61b for sliding movement therealong and which holds a cam follower 64. The actuating shafts 61a and 61b have their respective small diameter portions $61a_1$ and $61b_1$ each of which has a lower section fitted in a corresponding one of bores formed in the housing 1 and has a lower end fixed to a support plate 67. Large diameter portions $61a_2$ and $61b_2$ are integrally connected respectively to upper ends of the respective small diameter portions $61a_1$ and $61b_1$ through respective steps 61a and 61b. Upper ends of the respective large diameter portions $61a_2$ and $61b_2$ are fixedly connected to the second brake shoe 65b. The holder 60 is mounted on the small diameter portions $61a_1$ and $61b_1$. The holder 60 is usually biased upwardly by a pair of second springs 62 and 62. By the biasing force of the second springs 62 and 62, the cam follower 64 is urged against the first and second cams 63 and 70, and the holder 60 is urged against the steps 61a' and 61b' of the respective actuating shafts 61a and 61b. The support plate 67 is usually biased downwardly by a pair of springs 181c and 181d interposed between the support plate 67 and a release disc 56 subsequently to be described.

The strip braking device 151 in the illustrated embodiment is constructed as described above. When the first cam 63 is in a position shown in FIG. 8, the second springs 62 push the holder 60 up, and push up the acutating shafts 61a and 61b and the second brake shoe 65b through the steps 61a' and 61b' against the biasing force of the first springs 181c and 181d. Thus, the second brake shoe 65b is moved toward the first brake shoe 65a so that the strip is clamped between and fixed by the brake shoes 65a and 65b. When the drive shaft 2 rotates to rotate the first cam 63 from the position shown in FIG. 8 to a position where the neighborhood of a projection 63a on the first cam 63 is brought into engagement with the cam follower 64, the cam follower 64 is pushed down by the first cam 63 so that the holder 60 is pushed down against the biasing force of the second springs 62. Thus, the first springs 181c and 181d push down the actuating shafts 61a and 61b and the second brake shoe 65b as well as the support plate 67. This causes the second brake shoe 65b to move away from the first brake shoe 65*a* so that the strip is released from the brake shoes.

The operational relationship between the first cam 63 and the second brake shoe 65*b* has been described above. It is noted, however, that the first and second cams 63 and 70 are mounted respectively on the outer and inner shaft members 2*a* and 2*b* of the drive shaft 2 and are rotatively driven together with the outer and inner shaft members 2*a* and 2*b*. Like the projection 63*a* on the first cam 63, the second cam 70 also has a projection for pushing the cam follower 64 down. Adjustment of the relative angular position between the outer and inner shaft members 2*a* and 2*b* enables a position of the projection on the second cam 70 with respect to a position of the projection 63*a* on the first cam 63 to be set to an appropriate position angularly spaced from the position of the projection 63*a* in the rotational direction of the drive shaft 2. Accordingly, when the drive shaft 2 rotates, for example, in the counterclockwise direction from the position shown in FIG. 8 and the first cam 63 engages the cam follower 64 at a point a, the second brake shoe 65*b* is in the elevated position, because the first cam 63 does not push the cam follower 64 down, so that the strip is clamped between and fixed by the first and second brake shoes 65*a* and 65*b*. If the second cam 70 is so set that the neighborhood of its projection is brought into engagement with the cam follower 64 at that point of time, the cam follower 64 is pushed down by the projection on the second cam 70 to push the second brake shoe 65*b* down so that the strip is released from the first and second brake shoes. As will be described later in detail, the profile or configuration of the projection on the second cam 70 is so designed that the projection pushes the cam follower down temporarily for a short period of time, to release the strip from the brake shoes.

ROLL BRAKE RELEASE MECHANISM

Figure 7:
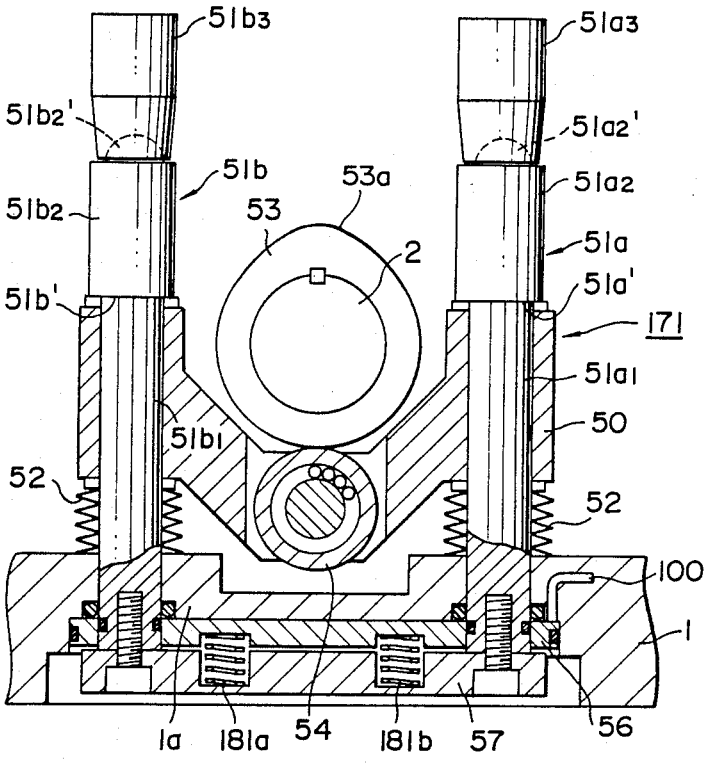
FIG. 7 is a cross-sectional view showing an interlocking mechanism of a roll release device, as viewed in side elevation of FIG. 1.

The roll feed apparatus according to the illustrated embodiment comprises a roll brake release mechanism for moving the second roll 17*b* away from the first roll 17*a* at any desired point of time and simultaneously for moving the second brake shoe 65*b* away from the first brake shoe 65*a*. The roll brake release mechanism includes the release disc 56 as shown in FIGS. 1, 7 and 8. The release disc 56 is located above the support plates 57 and 67. The lower sections of the respective actuating shafts 51*a* and 51*b* of the roll release device 153 and the lower sections of the respective actuating shafts 61*a* and 61*b* of the strip braking device 151 extend through the release disc 56. The release disc 56 is biased upwardly toward a wall 1*a* of the housing 1 by the springs 181*a*, 181*b*, 181*c* and 181*d*. Air is adapted to be introduced between the release disc 56 and the wall 1*a* through a pipe 100. That is, as air is introduced through the pipe 100, the release disc 56 is pushed down against the springs 181*a* through 181*d*. This causes the release disc 56 to push the support plates 57 and 67 down until they abut against a receiving plate 182 (see FIG. 1). As described previously, the support plate 57 is fixedly mounted to the actuating shafts 51*a* and 51*b* of the roll release device 153, and the support plate 67 is fixedly mounted to the actuating shafts 61*a* and 61*b* of the strip breaking device 151. Therefore, as the support plates 57 and 67 are pushed down by the release disc 56, the actuating shafts 52*a*, 51*b*, 61*a* and 61*b* are also pushed down. As a consequence, as will be clear from the foregoing description of the roll release device 153 and the strip breaking device 151, the second roll 17*b* is moved away from the first roll 17*a*, and the second brake shoe 65*b* is moved away from the first brake shoe 65*a*. The roll brake release mechanism described above is adapted to be actuated by an operator as occasion demands, independently of the usual operation of the roll feed apparatus attendant upon rotation of the drive shaft 2.

STRIP CLAMPING FORCE ADJUSTING MECHANISM

Figure 9:
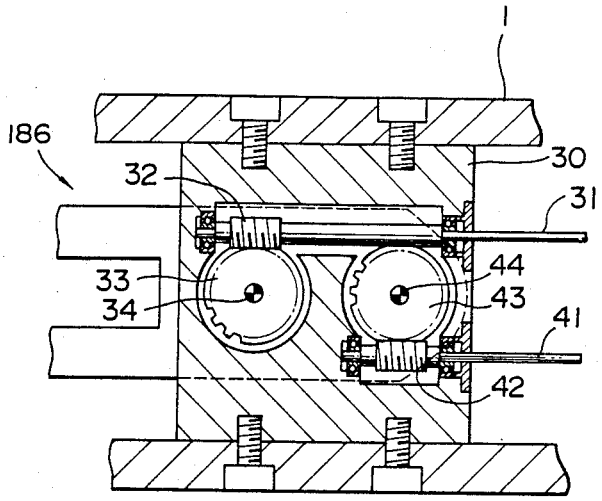
FIG. 9 is a fragmental cross-sectional view of a worm gear and wheel mechanism illustrated in FIG. 1, as viewed in top plan.

As shown in FIG. 1, a pivoting structure 185 has one end thereof mounted on a pivot 187 for pivotal movement about an axis thereof. The pivoting structure 185 is mounted, at its longitudinally midway position, on the first roll shaft 12*a* for angular movement relative thereto. The pivoting structure 185 and a worm gear wheel mechanism 186 (see FIGS. 1 and 9) form a strip clamping force adjusting mechanism.

The pivoting structure 185 comprises a pivoting plate 185A having one end thereof pivotally mounted on one end of the pivot 187. The pivoting plate 185A is mounted, at its longitudinally midway position, on the one end $12a_1$ (see FIG. 6) of the first roll shaft 12*a* for angular movement relative to the one end $12a_1$. The pivoting plate 185A is located on the front of the drawing sheet with respect to the first roll 17*a* as viewed in FIG. 1 and on the rear of the drawing sheet with respect to the first swinging arm 14*a*, the slide block 10 and the like. The pivoting structure 185 further comprises a second pivoting plate identical in configuration with pivoting plate 185A. The second pivoting plate extends parallel to the pivoting plate 185A and has one end pivotally mounted on the other end of the pivot 187. The second pivoting plate is mounted, at its longitudinally midway position, on the other end $12a_2$ (see FIG. 6) of the first roll shaft 12*a* for angular movement relative to the other end $12a_2$. The second pivoting plate is located on the rear of the drawing sheet with respect to the first roll 17*a* as viewed in FIG. 1. A plate member 185 B extending perpendicularly to the drawing sheet of FIG. 1 connects a free end of the pivoting plate 185A to a free end of the second pivoting plate.

The above-mentioned worm gear wheel mechanism 186 comprises a first worm wheel 43 threadedly engaged with a first screw rod 44, a first worm gear 42 mounted on one end of a first worm shaft 41 and in mesh with the first worm wheel 43, a second worm wheel 33 threadedly engaged with a second screw rod 34, and a second worm gear 32 mounted on one end of a second worm shaft 31 and in mesh with the second worm wheel 33. The first and second worm gears 42 and 32 as well as the first and second worm wheels 43 and 33 are accommodated in a case 30 fixedly mounted to the housing 1 of the roll feed apparatus. A lower end of the first screw rod 44 abuts, through a spring 46, against a bottom surface 185*c* of an upwardly opening recess formed in the plate member 185B of the pivoting structure 185. A support block 36 is attached to a lower end of the second screw rod 34 through a pin 35. The support block 36 abuts against a top surface 185B of a downwardly opening recess formed in the plate member 185D.

As will be clear from the construction described above, as the first worm shaft 41 is rotatively driven in the clockwise or counterclockwise direction, the first screw rod 44 moves upwardly or downwardly through the first worm gear and the first worm wheel 43, to thereby vary the spring force of the spring 46 which biases downwardly the free end of the pivoting structure 185. That is, the spring force of the spring 46 biasing the pivoting structure 185 in the clockwise direction about the axis of the pivot 187 varies and, therefore, the force urging the first roll shaft 12*a* and the first roll 17 mounted thereon, toward the second roll 17*b* varies. As a consequence, rotation of the first worm shaft 41 by an appropriate angular extent in the clockwise or counterclockwise direction makes it possible to adjust the clamping force acting on the strip clamped between the rolls 17*a* and 17*b* to an appropriate value. Further, as the second worm shaft 31 is rotatively driven in the clockwise or counterclockwise direction, the second screw rod 34 is moved through the second worm gear 32 and the second worm wheel 33 upwardly or downwardly depending upon the rotational direction of the second worm shaft 31, so that the free end of the pivoting structure 185 is moved up and down through the support block 36. In this manner, the pivoting structure 185 pivotally moves about the axis of the pivot 187 in the counterclockwise or clockwise direction, to move the first roll shaft 12*a* and the first roll 17*a* mounted thereon upwardly or downwardly thereby varying the size of a gap between the rolls 17*a* and 17*b*. Thus, rotation of the second worm shaft 31 by an appropriate angular extent in the clockwise or counterclockwise direction enables the gap between the rolls 17*a* and 17*b* to be adjusted to an appropriate value in compliance with the thickness of the strip to be transported.

As will be clear from the foregoing, appropriate adjustment of the rotational directions and the angular extents of the respective first and second worm shafts 41 and 31 makes it possible to impart appropriate clamping force to the strip and to accurately transport the same. Additionally, as will be clear from FIG. 1, the first brake shoe 65*a* is fixedly mounted to the underside of the pivoting structure 185. Accordingly, when the first roll 17*a* is moved toward and away from the second roll 17*b* by the above-described pivotal movement of the pivoting structure 185, the first brake shoe 65*a* is also moved toward and away from the second brake shoe 65*b*. Thus, a gap between the brake shoes is also adjusted to a value in compliance with the strip thickness.

OPERATION

The roll feed apparatus according to the illustrated embodiment is constructed as described above. As the drive shaft 2 is rotatively driven, the solid cam 4 and the first, second and third cams 63, 70 and 53 rotate together with the drive shaft 2. As will be clear from the foregoing description, the solid cam 4 swingingly moves the rolls 17*a* and 17*b* in the strip transporting direction $A_1'$ or in the opposite direction through the rotation transmitting device 152 and the interlocking mechanism 155 (refer particularly to FIGS. 1 and 3). The first and second cams 62 and 70 move the second brake shoe 65*b* toward and away from the first brake shoe 65*a* through the interlocking mechanism 180 (refer particularly to FIGS. 1 and 8). The third cam 53 moves the second roll 17*b* toward and away from the first roll 17*a* through the interlocking mechanism 171 (refer particularly to FIGS. 1 and 7).

Figure 10:
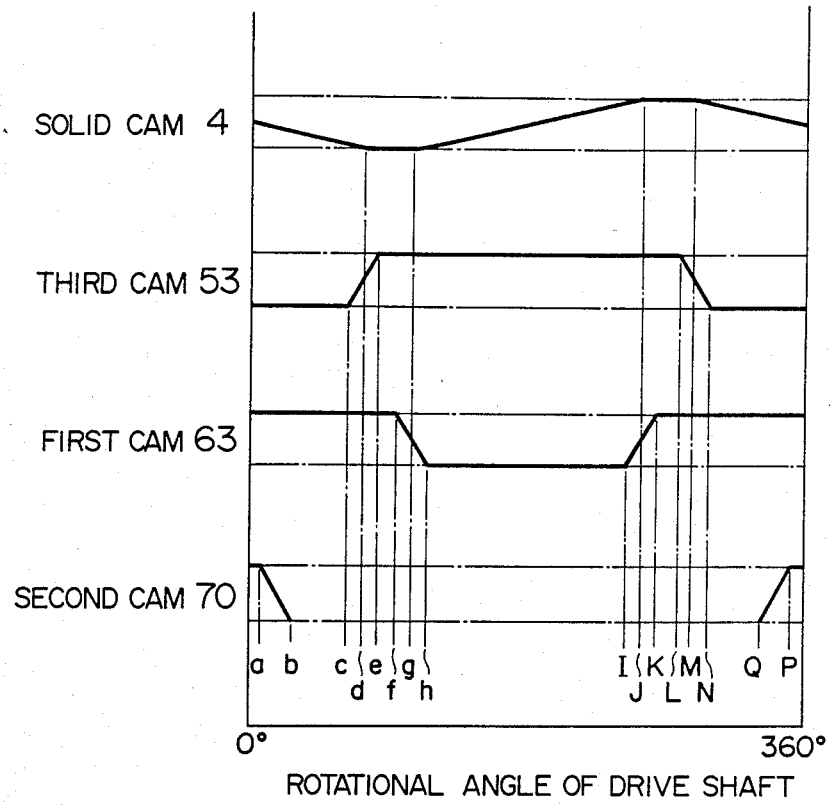
FIG. 10 is a graphical representation of an operational timing of the roll feed apparatus.

FIG. 1 shows the position where the first and second cams 63 and 70 move upwardly the second brake shoe 65*b* to fixedly clamp the strip between the first and second brake shoes 65*a* and 65*b*, while the third cam 53 moves downwardly the second roll 17*b* so that no clamping force is applied to the strip by the rolls 17*a* and 17*b*. Although the strip is not shown in FIG. 1, the strip is transported along the upper face of the guide member 21 from the right to the left. The position shown in FIG. 1 corresponds to a position where the rotational angle of the drive shaft 2 is zero degrees in FIG. 10.

As the drive shaft 2 rotates from the position of FIG. 1, the solid cam 4 swingingly moves the rolls 17*a* and 17*b* in the direction opposite to the strip transporting direction $A_1'$. The swinging movement of the rolls continues until the rotational angle of the drive shaft 2 is brought to a position d (see FIG. 10). From a position c of the rotational angle just before the position d, the third cam 53 begins to move the second roll 17*b* upwardly. At a position e of the rotational angle just after the position d, the rolls 17*a* and 17*b* clamp the strip therebetween. From the position of zero degrees of the rotational angle to a position f beyond the position e, the first cam 63 moves the second brake shoe 65*b* to fixedly clamp the strip between the brake shoes 65*a* and 65*b*. Thus, from zero degrees of the rotational angle to the position d, the rolls 17*a* and 17*b* swingingly move in the direction opposite to the strip transporting direction with the strip fixed by the brake shoes 65*a* and 65*b*. At the position e of the rotational angle after completion of the swinging movement of the rolls 17*a* and 17*b*, the rolls clamp the strip therebetween. The period from a position a to a position b of the rotational angle will be described later.

During the period from the position d to a position g of the rotational angle, the solid cam 4 maintains the rolls 17*a* and 17*b* stationary. From the position g to a position J of the rotational angle, the solid cam 4 swingingly moves the rolls 17*a* and 17*b* in the strip transporting direction $A_1'$. From the position e to a position L through the position J of the rotational angle, the third cam 53 causes the rolls 17*a* and 17*b* to clamp the strip therebetween. From the position f between the positions e and g of the rotational angle, the first cam 63 begins to move the second brake shoe 65*b* downwardly to release the strip from the brake shoes 65*a* and 65*b*. From a position I of the rotational angle, the first cam 63 begins to move the second brake shoe 65*b* upwardly. Until the rotational angle reaches a position K beyond the position J, the first cam 63 maintains the strip released from the brake shoes. Thus, during the above-described swinging movement of the rolls 17*a* and 17*b* in the strip transporting direction $A_1'$, the strip is transported by the rolls to the left as viewed in FIG. 1.

In a manner similar to that described above, the rolls 17*a* and 17*b* are maintained stationary from the position J to a position M of the rotational angle. Subsequently, from the position M to 360 degrees of the rotational angle, the rolls swingingly move in the direction opposite to the strip transporting direction $A_1'$. During the period between the positions J and M of the rotational angle for which the rolls are maintained stationary, the brake shoes 65*a* and 65*b* first fixedly clamp the strip therebetween at the position K of the rotational angle and, subsequently, the rolls 17*a* and 17*b* begin to release the strip at the position L of the rotational angle. Between the position M and 360 degrees of the rotational angle, the downward movement of the second roll 17*b* is first completed at a position N of the rotational angle. Subsequently, between positions Q and P of the rotational angle, the second brake shoe 65*b* is moved downwardly by the second cam 70. The second brake shoe 65*b* is maintained at the lowered position until the drive shaft 2 enters its second rotation and the second cam 70 moves upwardly the second brake shoe 65*b* from the position a to the position b of the rotational angle. Accordingly, until the rotational angle proceeds from the position M to the position of 360 degrees and the position d of the rotational angle of the second rotation is reached, the rolls 17*a* and 17*b* swingingly move in the direction opposite to the strip transporting direction with the strip fixedly clamped between the brake shoes 65*a* and 65*b*. However, during a short period of time from the position Q to the position b through the position of 360 degrees of the rotational angle, the brake shoes 65*a* and 65*b* temporarily release the strip. As the drive shaft 2 continues to rotate, the above-described operations are repeated.

As will be clear from the foregoing, during continuous rotation of the drive shaft 2, the rolls 17*a* and 17*b* repeatedly perform strokes including the swinging movement in the strip transporting direction (strip transporting stroke) with the strip clamped between the rolls, the rest, the swinging movement in the direction opposite to the strip transporting direction (return stroke) with the strip released, and the rest. During the period of the rest after the rolls 17*a* and 17*b* have completed the strip transporting stroke, the brake shoes 65*a* and 65*b* first fixedly clamp the strip therebetween (at the rotational angle K in FIG. 10) and, subsequently, the rolls 17*a* and 17*b* release the strip (at the rotational angle L) and perform the return stroke. During the period of the rest after the rolls have completed the return stroke, the rolls first clamp the strip therebetween (at the rotational angle e) and, subsequently, the brake shoes 65*a* and 65*b* release the strip (at the rotational angle f). In this manner, the strip is clamped between at least one of the rolls and the brake shoes at all points of time during the operation of the roll feed apparatus so that the strip is prevented from becoming released and free from both of the rolls and the brake shoes. This is extremely preferable in that it is possible to prevent deterioration of feeding accuracy due to inertia force and the like of the strip.

However, if the roll feed apparatus is utilized, for example, to feed a strip into the above-described press machine or the like which employs the die assembly having positioning pilot pins, it is desirable to make the strip free temporarily in an instant that the upper and lower dies move toward each other and the strip is positioned with respect to the die assembly. The arrangement of the roll feed apparatus according to the illustrated embodiment is such that the rolls 17*a* and 17*b* perform the strip transporting stroke to feed the strip by a constant length into the press machine and, subsequently, the press working is effected during the return stroke of the rolls, such that the brake shoes 65*a* and 65*b* can release the strip temporarily in time to movement of the upper and lower dies toward each other (from the position Q to the position b of the rotational angle in FIG. 10). Thus, the above-mentioned desire can be fulfilled.

It will be apparent that the above-described operational timing of the roll feed apparatus is obtained by appropriate determination or setting of the profile and the like of the respective cam surfaces of the solid cam 4 and the first, second and third cams 63, 70 and 53. Further, it is as described above that the relationship between the operation of the brake shoes due to the first cam 63 and the operation of the brake shoes due to the second cam 70 can suitably be adjusted by adjustment of the relative angular position between the outer and inner shaft members 2*a* and 2*b* of the drive shaft 2.

As described above, the roll feed apparatus according to the inveniton can feed a strip by a constant length into various kinds of manufacturing machines with high accuracy. In addition, if the manufacturing machine is of type having incorporated therein a positioning device for the strip, the roll feed apparatus can make the strip free temporarily in time to operation of the positioning device, to thereby enable the positioning device to perform the positioning of the strip in a reliable manner.

What is claimed is:

1. A roll feed apparatus comprising:

a drive shaft rotatively driven;

a pair of first and second roll shafts;

a pair of first and second rolls mounted respectively on said first and second roll shafts for swinging movement therewith;

swingingly driving means for converting rotative motion of said drive shaft into swinging movement of said first and second rolls;

said first and second rolls cooperating with each other to clamp a strip therebetween to transport the strip when said first and second rolls are moved swingingly by said swingingly driving means in a strip transporting direction;

can means mounted on said drive shaft for rotation therewith;

a pair of first and second brake shoes confronting each other with a strip transporting path passing between said brake shoes;

interlocking means operatively connecting said second roll and second brake shoe to said cam means, and including cam follower means, means holding said cam follower means and operatively connected to said second roll and said second brake shoe, and means for biasing said holding means in a direction to bring said cam follower means into engagement with said cam means and to urge said second brake shoe toward a brake position in which said brake shoes brake and fix the strip;

said interlocking means being operable, in response to rotation of said cam means, to move said second roll against said biasing means from said clamp position to a release position in which said rolls release the strip and to move in cooperation with said biasing means said second brake shoe from an unbrake position in which said brake shoes release the strip to said brake position, when said rolls swingingly move in a direction opposite to said strip transporting direction;

manually operable pneumatic means operatively connected to said holding means for manually pneumatically moving said holding means against said biasing means, thereby bringing said cam follower means out of engagement with said cam means and moving said second roll and said second brake shoe to said release position and said unbrake position, respectively.

2. Roll feed apparatus in accordance with claim 1, wherein said interlocking means comprises support plate means, and said roll feed apparatus includes actuating shaft means for operatively interconnecting said support plate means and said holding means for moving said holding means in response to movement of said support plate means, and means operatively connecting said pneumatic means with said support plate means for moving said support plate means.

3. Roll feed apparatus in accordance with claim 2 wherein said means connecting said pneumatic means with said support plate means comprises release disc means mounted in said interlocking means, said release disc means having first and second sides, said first side being mounted in said interlocking means with said first side adjacent to and facing said support plate means, and said second side operatively connected with said pneumatic means for forcing said release disc toward said support plate and moving said support plate upon activation of said pneumatic means.

4. Roll feed apparatus in accordance with claim 3 wherein said interlocking means includes spring means disposed between said release disc means and said support plate means for biasing said release disc means from said support plate means.

* * * * *